United States Patent [19]

Epes

[11] 4,065,893

[45] Jan. 3, 1978

[54] COMPOSITE FOUNDATION FRAMING ASSEMBLY

[76] Inventor: Archie C. Epes, P.O. Box 3574, Shreveport, La. 71103

[21] Appl. No.: 649,667

[22] Filed: Jan. 16, 1976

[51] Int. Cl.[2] ..... E04C 2/26

[52] U.S. Cl. ..... 52/169.11; 52/309.7; 52/309.8; 52/624

[58] Field of Search ..... 52/515, 169 R, 309, 52/624, 627, 292, 293

[56] References Cited

U.S. PATENT DOCUMENTS

| | | | |
|---|---|---|---|
| 2,598,498 | 5/1952 | Brown | 52/515 X |
| 2,899,771 | 8/1959 | Barris, Jr. | 52/169 |
| 3,277,219 | 10/1966 | Turner | 52/309 X |
| 3,300,936 | 1/1967 | Trauaglia | 52/169 X |
| 3,372,520 | 3/1968 | Hensel | 52/624 X |
| 3,402,519 | 9/1968 | Evers | 52/295 |
| 3,561,175 | 2/1971 | Best et al. | 52/169 |
| 3,729,880 | 5/1973 | Eliason | 52/309 X |
| 3,763,612 | 10/1973 | Sanio | 52/627 X |
| 3,798,858 | 3/1974 | Turner | 52/169 |
| 3,841,041 | 10/1974 | Friedland | 52/169 |

FOREIGN PATENT DOCUMENTS

| | | | |
|---|---|---|---|
| 1,084,009 | 6/1960 | Germany | 52/309 |

*Primary Examiner*—Leslie Braun

[57] ABSTRACT

Composite members for foundation, floor and roof systems in structures, including multistory structures, the roof assembly of which includes a ceiling and roof member, between which members is sandwiched an expanded foam material; the floor and alternative foundation assembly of which includes base, intermediate, and top members, each having expanded foam material sandwiched therebetween; and a foundation assembly comprising a sub-floor member and a channel member having expanded foam material sprayed or poured thereon, which foundation assembly is adapted to rest on a suitable fill such as sand or fill soil.

1 Claim, 10 Drawing Figures

COMPOSITE FOUNDATION FRAMING ASSEMBLY

BACKGROUND OF THE INVENTION

1. Field of the Invention

This invention relates to job site, factory fabricated and modular structural systems for facilitating the rapid construction of roofs, floors, and foundations in family dwellings, including mobile homes, and commercial structures, and more particularly, to new and improved composite framing assemblies having exceptionally good insulating, sound deadening, and shock resistant properties in addition to high strength, in such structures. The invention enhances the shock resistant and load-carrying capability of conventional structures and also provides good insulating and sound deadening properties for such improvements.

2. Description of the Prior Art

Heretofore, the principal method of building homes, including mobile homes and commercial buildings has been digging footings, pouring concrete and installing piers, in the case of mobile homes, or digging footings, setting forms and pouring a concrete slab, all at substantial cost. Such variables as weather conditions, the availability of labor, and the time required to complete the job combine to make such conventional operations expensive and time-consuming. For example, after the slab is poured, conventional wall framing and floor framing must be undertaken, which again requires coordination between labor and materials, and necessarily results in dependence upon good weather.

After the floor and wall framing operations have been completed, the roof must be built, and coordination of labor and materials and good weather are factors which frequently necessitate additional expense and time in construction. With the ever increasing cost of labor and materials, any construction procedure which can be utilized to cut down the time of construction and to make best and most efficient use of materials necessarily results in decreased construction costs.

It has been fund that use of expanded foam materials such as expanded polyurethane foam can be very useful as a material of construction. For example, expanded polyurethane retains structural integrity under both compressive and tensile loading conditions and is characterized by excellent insulating properties. Rigid urethane foam having a density of about two pounds per cubic foot has been found to withstand compressive loads of up to about 35 pounds per square inch with only a ten percent deflection. Foam of the same density will also withstand a tensile load of up to about 35 pounds per square inch. When the foam density is increased to five pounds per cubic foot the compressive load necessary to realize a 10 percent deformation rises to slightly in excess of 100 pounds per square inch, and the tensile load increases to about 120 pounds per square inch.

Accordingly, it is an object of this invention to provide a composite framing assembly which utilizes an expanded foam material having a density of from about two to about six pounds per cubic foot.

Another object of the invention is to provide a composite framing assembly which utilizes foundation, floor and roof sections.

Yet another object of the invention is to provide a foundation, floor, and roof composite framing assembly for substantially any structure, wherein extensive excavation of the site, digging and pouring of concrete footings and the setting of forms or the driving of piles is not necessary to provide a firm foundation.

Another object of the invention is to provide a composite framing assembly which requires less time to implement than conventional systems, thereby saving money in construction costs.

A still further object of the invention is to provide composite foundation, floor and roof framing assemblies which have superior load bearing, sound deadening, shock resistant and insulation characteristics, and in which the floor assembly may also serve as a foundation assembly as well as a multiple floor assembly.

Yet another object of the invention is to provide a composite framing assembly for constructing foundations, floor systems and roof systems, respectively for structures, which assembly may be prefabricated or assembled as a modular unit or, in the alternative, may be formed and reenforced as described herein and foamed in place as a single unit with walls constructed in accordance with known techniques, and has superior insulating, sound deadening, shock resistant and load bearing characteristics.

Another object of the invention is to provide roof and floor assemblies in which the bottom component in the assemblies serves to form the ceiling of the structure.

SUMMARY OF THE INVENTION

These and other objects of the invention are provided in a composite framing assembly which includes a composite foundation framing assembly, a composite floor framing assembly and a composite roof framing assembly, the latter two assemblies of which have top and base, or ceiling members with an expanded foam material sandwiched therebetween, and the foundation framing assembly of which has an expanded foam material sprayed or poured on the underside thereof, in order to provide superior insulating, sound deadening, shock resistant and load bearing characteristics.

BRIEF DESCRIPTION OF THE DRAWINGS

The invention will be better understood in view of the following description presented with reference to the accompanying drawings.

DESCRIPTION OF THE PREFERRED EMBODIMENTS

Figures 1, 2, 3, 4, 5, 6, 7, 8, 9, 10:
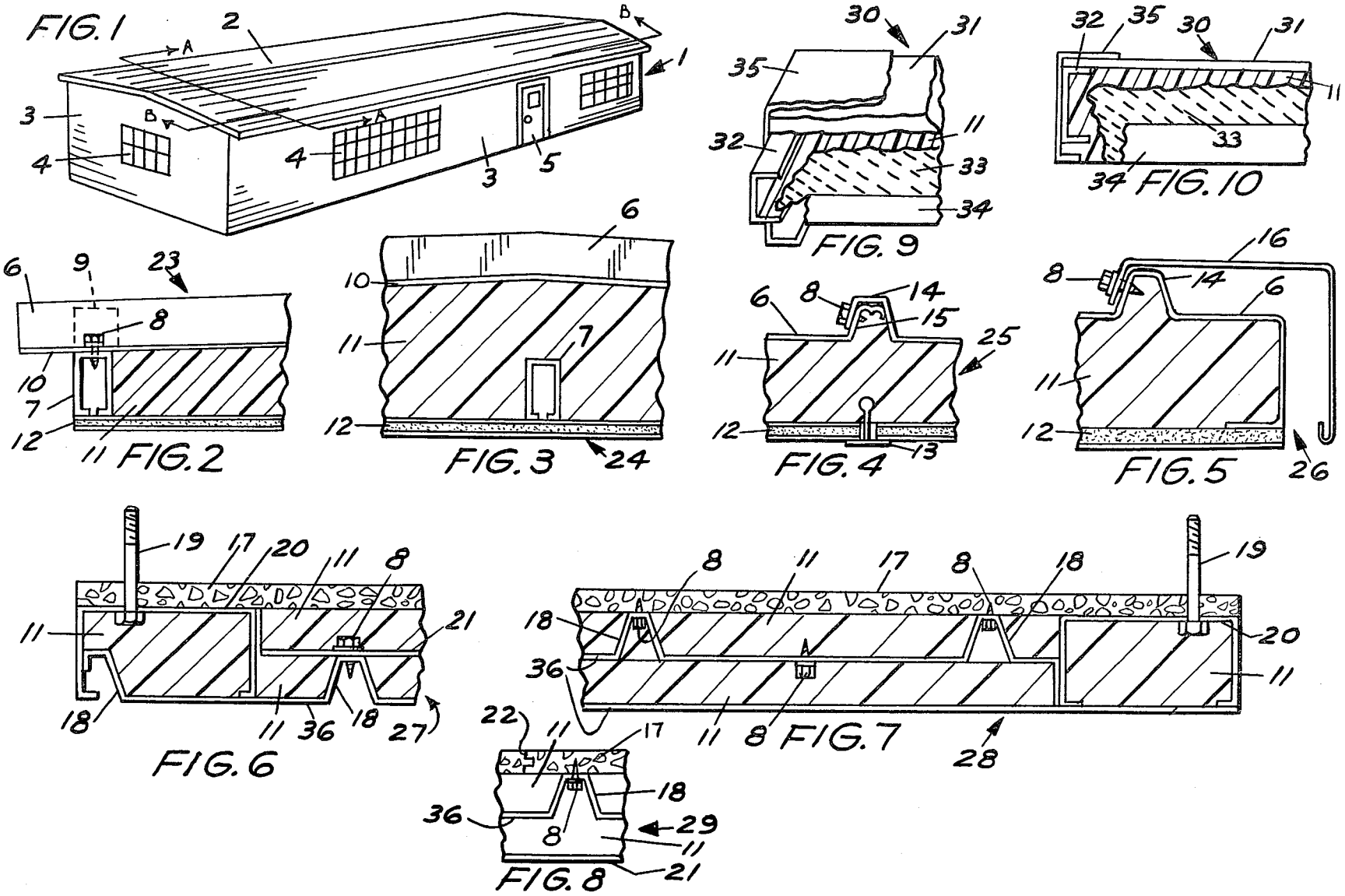
FIG. 1 of the drawings is a perspective view of a typical structure to which the assemblies of this invention are applicable.
FIG. 2 is a sectional view of a typical composite roof framing assembly of the invention taken along lines AA in FIG. 1, illustrating the edge or eave of the roof and an electrical chase which also serves as a reinforcing member.
FIG. 3 is a sectional view of a typical composite roof framing assembly taken along lines AA in FIG. 1 at the ridge of the roof also showing an additional electrical chase.
FIG. 4 is a sectional side view of a typical composite roof framing assembly taken along lines BB of FIG. 1 illustrating splicing of ceiling member 12 and roofing panels 6.
FIG. 5 is a sectional side view of a typical composite roof framing assembly taken along lines BB of FIG. 1 and illustrating a typical roof rake configuration.
FIG. 6 is a sectional view of a typical composite floor and foundation framing assembly of the invention taken along lines AA of FIG.1 and illustrating a typical sill configuration.
FIG. 7 is a sectional side view of a typical composite floor and foundation framing assembly illustrated in FIG. 6 and taken along lines BB of FIG. 1.
FIG. 8 is a sectional side view of the composite floor and foundation framing assembly illustrated in FIG. 7 more particularly illustrating a preferred tongue-and-groove splicing of subfloor member 17.
FIG. 9 is a perspective view, partially in section, of an alternate composite foundation framing assembly of this invention.
FIG. 10 is a sectional end view of the alternate composite floor and foundation framing assembly illustrated in FIG. 9, more particularly illustrating the composite nature of the assembly and the relationship between the assembly and the underlying earth and sand fill.

Referring now to FIG. 1 of the drawing, a typical structure 1 for appliation of the composite roof, floor and foundation assemblies is illustrated, with roof 2, walls 3, windows 4, and door 5. It will be appreciated that the structure may be a mobile home or foundation-based, as hereinafter discussed, or, as heretofore noted, the entire structure can be foamed in place.

Referring now to FIGS. 2–5, various sectional elements of the composite roof structure of this invention are illustrated. FIG. 2 illustrates composite roof eave framing assembly 23 in end sectional elevation, with closure 9, and roofing base 10 of roofing panel 6 joined to roof channel 7 by means of metal screws 8. Roof channel 7, which serves as an electrical chase and structural member, is in turn joined to ceiling 12, and the space between ceiling 12 and roofing base 10 is filled with expanded foam material 11. FIG. 3 illustrates the composite roof ridge framing assembly in end sectional elevation, generally indicated by reference numeral 24, with roof channel 7 mounted on ceiling 12 and spaced from roofing panel 6 by expanded foam material 11. The expanded foam material 11 is preferably substantially thicker at the ridge area than in the vicinity of the eave to provide additional roof strength and insulation. FIG. 4 illustrates composite spliced roof framing assembly 25 in side sectional elevation, wherein ceiling 12 is spliced by application of tee closure 13 and roofing panel 6 is spliced by overlapping outside roofing panel crimp 14 and inside roofing panel crimp 15 and joining the crimped metal with metal screws 8. FIG. 5 illustrates composite roof rake framing assembly 26 in side sectional elevation with rake trim 16 overlapping roofing panel 6 outside of roofing panel crimp 14 at the outer periphery of the roof assembly. Roofing panel 6 is molded to join ceiling 12 within the confines of rake trim 16, and rake trim 16 is typically joined to outside roofing panel crimp 14 by means of metal screws 8.

FIG. 6 illustrates a sectional end view of composite floor and foundation sill framing assembly 27, with subfloor panel 17 and reinforcing floor panels 36, along with floor channel 20, and expanded foam material 11 in sandwiched relationship. Floor channel 20 is disposed in the outer edge of each side of composite floor sill and foundation framing assembly 27, and strength is added to the assembly in the form of reinforcing floor panels 36 which are secured together by means of floor panel crimps 18 and metal screws 8. Anchor bolt 19 serves to join floor sill and foundation assembly 27 to a cooperating wall assembly (not illustrated).

FIG. 7 illustrates a side sectional view of the composite floor and foundation sill framing assembly illustrated in FIG. 6, generally illustrated by reference numeral 28, with reinforcing floor panels 36, fitted with panel crimp 18, and spaced from subfloor panel 17 by expanded foam material 11. Anchor bolt 19 serves to join the floor assembly and a cooperating wall section, as in the case of composite floor sill framing assembly 27.

FIG. 8 of the drawing illustrates a sectional side view of composite floor splice assembly 29, wherein subfloor panel 17 is spliced at tongue-and-groove joint 22. As illustrated in FIG. 7, subfloor panel 17 and the bottom one of reinforcing floor panels 36 are spaced by expanded foam material 11 and the top one of reinforcing floor panels 36, and subfloor panel 17 is reinforced by joining it with floor panel crimp 18 by means of metal screws 8.

Referring now to FIGS. 9 and 10 of the drawing an alternative composite foundation and floor framing assembly 30 is illustrated, with subfloor cap 31 abutting foundation channel 32 and expanded foam material 11, sprayed or poured on the underside of subfloor cap 31, which is adapted to rest on sand fill 33, packed on top of fill soil 34. In order to prevent moisture from entering the interior of the assembly, a waterproof coating 35 is applied from the top edge of subfloor cap 31 down the side of the assembly adjacent foundation channel 32, and under expanded foam material 11, adjacent sand fill 33. FIG. 9 further illustrates the composite structure of composite foundation and floor framing assembly 30, and it will be apparent that the amount of expanded foam 11 utilized in the assembly may vary depending upon load specifications. For example, if the structure requires extensive shock resistance and very good insulating properties, the layer of expanded foam 11 may be increased substantially, and the thickness of subfloor cap 31 may also be increased as desired. It will be appreciated that foundation channel 32 and waterproof coating 35 extend the entire length of all sides of the assembly and expanded foam material 11 and subfloor cap 31 act as the slab, supported by the sand and soil fill. This type of foundation provides a slab which is 8 inches or more above the ground, which assures termite protection and protection of the structure from surface water.

While it will be appreciated that the shape, thickness and materials of construction utilized in the invention may be varied without departing from the spirit and scope thereof, in a preferred embodiment, the composite framing assemblies illustrated in FIGS. 2–10 of the drawing are designed as illustrated in the drawing. For example, under circumstances where roof loading is minimal, and referring again to FIG. 3 of the drawing, the expanded foam material, preferably polyurethane, may be thinner than it is as illustrated. Furthermore, the thickness of ceiling 12, which may be gypsum board or the equivalent, may be varied as desired to impart a greater or lesser insulating and/or fireproofing aspect to the structure.

Regarding composite foundation and floor framing assembly 28 illustrated in FIG. 7 of the drawing, subfloor panel 17, which is preferably plywood or chipboard, may, in the alternative, be constructed of substantially any other suitable building material, such as fiberglass, vinyl or other types of plastic, depending upon the economics of the construction and the strength, abrasion and shock resistance necessary in the floor framing assembly. For example, under circumstances where shock resistance must be high, subfloor panel 17 may be constructed of several layers, or a single, thick layer of plywood or other suitable material, and the expanded foam layers may be as thick as desired in order to impart the necessary shock resistance and strength. In the case of multistory structures, and referring to FIGS. 2–5 of the drawing, ceiling 12 may be decorated as desired before the expanded foam material is applied. Referring again to FIGS. 2–5 of the drawing, it will be recognized that increasing the thickness of the expanded foam material imparts greater insulating characteristics and strength to the structure. It will also be appreciated that increasing the density of the expanded foam also increases the strength of the structure formed. Furthermore, as in the case of the composite roof framing assembly, and referring again to FIGS. 6 and 7 of the drawing, floor panel crimps 18 may be spaced closer together or farther apart, or may be thicker and heavier, as desired, in order that reinforcing floor panel 36 supply the necessary strength and stiffness to the floor framing assembly for given design load requirements. Furthermore, referring again to FIGS. 6 and 7 of the drawing, depending upon strength requirements, either of floor panels 36 may be absent from the structure.

In like manner, alternate composite foundation framing assembly 30, illustrated in FIGS. 9 and 10 of the drawing may be prefabricated according to predetermind specifications, and may be constructed of a variety of shapes, thicknesses and sizes using a variety of materials of construction dictated only by the particular construction design requirements of the specific job. Foundation and floor (including the upper floor) framing assembly 28, like the roof assemblies, may be manufactured to exact specifications in the shop, and quickly and easily moved to the construction site upon demand. In the alternative, they may be formed and built in place as heretofore described, with the foam poured as the structure rises. In order to prepare the site for implementation of a composite foundation framing assembly, a specified fill, usually a soil and sand fill, must first be prepared, and the foundation assembly placed on top of the fill, as illustrated in FIGS. 9 and 10 of the drawing. In the alternative, a mud or sand slurry may be pumped under a foundation framing assembly which has been previously set on a preliminary soil fill or other base to provide the necessary final fill. In this manner loading on unsubstantial soil may be accomplished with minimum time and expense. For example, the respective composite assemblies of this invention may be effectively utilized in the arctic regions where permafrost exists, as well as marshy areas of the country, and the required insulating and stiffening properties may be built into the structure according to predetermined specifications for particular environmental conditions. Only a flat, preferably sandy area is required, and as heretofore discussed, both composite floor sill and foundation framing assemblies 27 and 28 and alternate composite foundation and floor foaming assemblies 30 can be used to form the foundation member in this invention.

The pre-constructed composite framing assemblies of this invention may be built as modular units in the shop or rapidly erected on the job, primarily due to the composite nature of the construction, and the capability of construction to predesigned specifications. Of course, it will be recognized that after the composite foundation, floor, and roof framing assemblies have been built into the structure, conventional techniques may then be used to complete the structure in accordance with design specifications.

It will be appreciated that a primary feature and advantage of this invention is the provision of a combination foundation floor assembly, and particularly an upper floor and lower story ceiling assembly, which is sufficiently strong to withstand a considerable load, and which may be implemented without the use of conventional floor joists and accompanying nails and labor necessary to build these joists. Referring again to FIG. 7 of the drawing, the sandwich construction of composite floor framing assembly 28, and the use of reinforcing floor panels 36, typically ribbed galvanized steel sheets as "stiffeners" in the composite, permits a large load-bearing capability without the use of floor joists, and the assembly may be built to predetermined specifications in the shop. Additional strength can be added to the assembly by increasing the thickness of expanded foam 11 and floor panel 17 and also by use of reinforcing floor panels 36 having floor panel crimps spaced as close together as is necessary to minimize flexure of the assembly for given load requirements.

Another principal advantage of the invention lies in the structure of the composite foundation framing assembly which permits the assembly to be placed over a prepared fill without the requirement of a pre-poured slab, sills, or footings. Since the rot-resistant expanded foam material as illustrated in FIGS. 9 and 10 is sprayed on the underside of the foundation cap and is in direct contact with the fill, the foundation is not susceptible to rotting or other deterioration, as is prevalent in the case of wooden sills and underpinnings. Furthermore, since the foundation assembly of this invention is relatively light in weight as compared to conventional slab foundations, the assembly can be easily transported, handled and placed on semi-stable soil, such as is found in marshy and permafrost regions of the country, as heretofore noted. It will be appreciated that the expanded foam material must be shielded from exposure to the sun to prevent deterioration.

Having thus described the invention with the particularities set forth above, what is claimed is:

1. A composite foundation framing assembly for installation on a fill support comprising:

a. a foundation subfloor forming the top of said assembly;

b. a foundation U-shaped channel having one leg beneath and adjacent said foundation subfloor and the web member co-extensive with the peripheral edge of said foundation subfloor and disposed downwardly at essentially a 90° angle with respect to said foundation subfloor to form a portion of the sides of said foundation framing assembly;

c. a layer of expanded foam material having a density of from about two to about five pounds per cubic foot on the underside of said foundation subfloor and disposed between and beneath the legs of said foundation channel to form the lowermost member of said assembly and adapted to be in contact with said fill support; and d. a waterproof coating extending from the top of and in continuous contact with said foundation subfloor around said peripheral edge of said foundation subfloor, across said foundation channel, and terminating under said layer of expanded foam material.

* * * * *